United States Patent [19]

Nohira et al.

[11] 4,040,402

[45] Aug. 9, 1977

[54] EXHAUST GAS RE-CIRCULATION SYSTEM FOR AN INTERNAL COMBUSTION ENGINE

[75] Inventors: Hidetaka Nohira; Kiyoshi Kobashi; Masaaki Tanaka, all of Susono, Japan

[73] Assignee: Toyota Jidosha Kogyo Kabushiki Kaisha, Toyota, Japan

[21] Appl. No.: 658,109

[22] Filed: Feb. 13, 1976

[30] Foreign Application Priority Data

Oct. 11, 1975 Japan ..... 50-121799

[51] Int. Cl.[2] ..... F02M 25/06

[52] U.S. Cl. ..... 123/119 A

[58] Field of Search ..... 123/119 A

[56] References Cited

U.S. PATENT DOCUMENTS 3,888,222 6/1975 Tomita ..... 123/119 A 3,924,589 12/1975 Nohira ..... 123/119 A 3,962,868 6/1976 Matumoto ..... 123/119 A

FOREIGN PATENT DOCUMENTS 2,365,341 11/1974 Germany ..... 123/119 A

*Primary Examiner*—Douglas Hart

*Attorney, Agent, or Firm*—Stevens, Davis, Miller & Mosher

[57] ABSTRACT

An exhaust gas re-circulation system for an internal combustion engine is provided with a single flow-control valve for regulating the flow of the re-circulating exhaust gas which is re-introduced from an exhaust system of the engine into an intake system of the engine in a two step-like manner, depending upon change in the state of operation of the internal combustion engine and/or change in the operating condition of said internal combustion engine.

9 Claims, 5 Drawing Figures

EXHAUST GAS RE-CIRCULATION SYSTEM FOR AN INTERNAL COMBUSTION ENGINE

BACKGROUND OF THE INVENTION

The present invention relates to an exhaust gas recirculation system (EGR) provided for an internal combustion engine, and more particularly to an improvement in an EGR system for accomplishing the reduction in the amount of nitrogen oxides ($NO_x$) contained in the exhaust emission from an internal combustion engine, at a low cost.

In an internal combustion engine, particularly in a car engine, exhaust gas re-circulation has been widely used as an effective method for reducing the amount of harmful $NO_x$ emitted from the car engine, since the legislative standards for limiting the amount of $NO_x$ exhausted from a car engine to a specific low level has become increasingly strict. However, those skilled in the art know that usage of said EGR method for a car engine often causes a decrease in the engine performance, since inactive exhaust gas is re-introduced into an intake system of the car engine. Therefore, if the EGR method is used for an internal combustion engine in order to ensure appropriate engine performance as well as to acquire the highest possible reduction of $NO_x$, it is necessary to carefully regulate the amount of the re-circulating exhaust gas in response to the change in the state of operation of an internal combustion engine and/or a vehicle in which the engine is mounted. In order to meet the above requirement, an improvement of an EGR system of an internal combustion engine has already been proposed by which two separate flow-control valves are arranged so as to control the flowing amount of the exhaust gas re-introduced from an exhaust system into an intake system of an internal combustion engine in a two step-like manner, depending upon the change in the state of the engine operation. However, because of the two separate flow-control valves in the EGR system, the distribution of the EGR gas pipelines in the engine compartment and the physical structure within said engine compartment for mounting the two flow-control valves becomes very complicated. Further, the time and operation required for mounting said two flow-control valves causes a large decrease in the productivity of workers making the engine, and thus an increase in the cost for manufacturing the engines.

SUMMARY OF THE INVENTION

It is therefore an object of the present invention to eliminate the drawbacks encountered by the previously proposed improvement in an EGR system for an internal combustion engine.

Another object of the present invention is to provide an EGR system for an internal combustion engine whereby the performance of the internal combustion engine can always be appropriately maintained depending not only upon a change in the load condition applied to the engine but also on a change in the operating condition of the engine in addition to various ambient conditions of the vehicle in which said engine is mounted.

In accordance with the present invention, an exhaust gas re-circulation system for an internal combustion engine is characterized by comprising, an exhaust gas recirculation pipeline extending between an intake system and an exhaust system of the internal combustion engine for re-introducing a part of the exhaust gas from the exhaust system into the intake system, a single flow-control valve for regulating the flow of the re-introduced exhaust gas, which comprises: an orifice element arranged in a portion of the exhaust gas re-circulation pipeline to provide said portion with an orifice through which the exhaust gas flows from the exhaust system toward the intake system; a valve element movably placed over the orifice and having an axially extended valve stem; a first displaceable diaphragm member connected to said valve stem for actuating the movement of the valve element away from the orifice; a second displaceable diaphragm member axially spaced apart from the first diaphragm member and having means for limiting the movement of said valve element; a first closed pressure-control chamber defined between the first and second diaphragm members; a second closed pressure-control chamber arranged adjacent to but separated from said first closed pressure-control chamber by said second diaphragm member; and an atmospheric pressure chamber arranged adjacent to but separated from said first closed pressure-control chamber by said first diaphragm member, and means for first generating in the first and then in the second pressure-control chambers, individual vacuum pressures which change in response to change in the opening position of a throttle valve of the intake system from the closed position thereof, said separate vacuum pressures of the first and second pressure-control chambers causing sequential displacements of said first and second diaphragm members thereby moving the valve element away from the orifice in a two step-like manner.

The present invention will become fully apparent from the ensuing description with reference to the accompanying drawings wherein.

Figure 3:
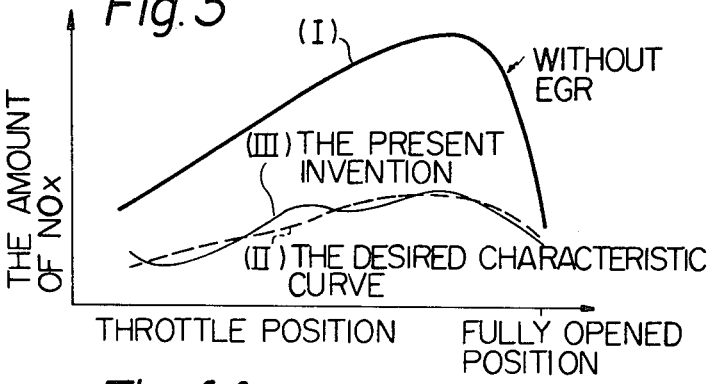
Figure 4A:
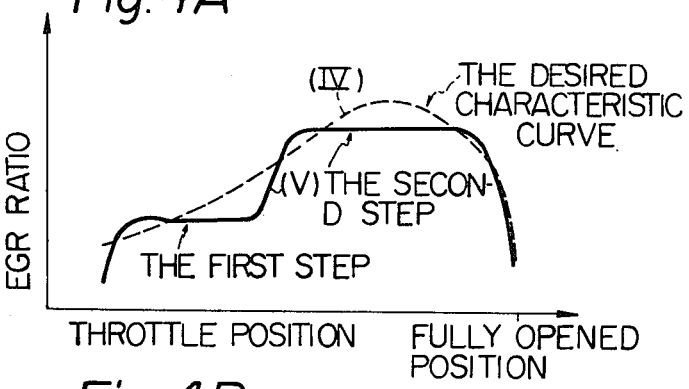
Figure 4B:
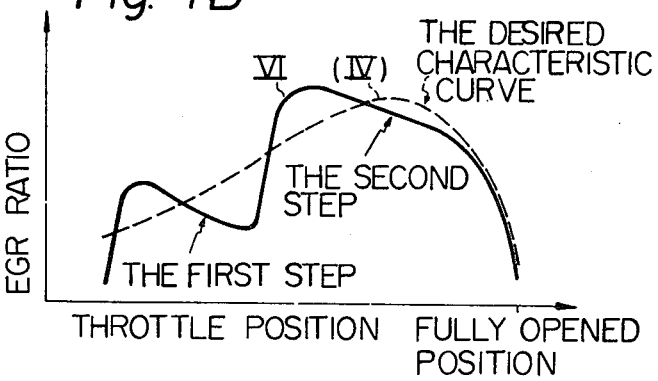

FIG. 3 is a graphic diagram on which three characteristic curves showing the relationship between the position of a throttle valve and the amount of $NO_x$ exhausted, are respectively plotted wherein the first curve represents a case wherein the EGR method is not used, the second shows the desired case where the legislative standard for reduction of $NO_x$ is satisfied and the last indicates a case wherein the EGR method is performed by the EGR system according to the present invention;

FIG. 4A is a graphic diagram on which two characteristic curves are plotted to show the relationship between the opening position of a throttle valve and the EGR ratio to the flow of the intake air, wherein the first curve shows the desired case, while the other indicates a case wherein the EGR system according to the present invention is used to re-introduce the EGR gas into a portion of a carburetor air horn positioned above the throttle valve, and FIG. 4B is a graphic diagram of which two characteristic curves similar to the curves of FIG. 4A are plotted, but show cases where the exhaust gas is re-introduced into a portion of an intake duct located below the throttle valve.

Prior to the description of the present invention, the background thereof will be described in more detail with reference to the characteristic curves of FIGS. 3, 4A and 4B.

Those skilled in the art know that the magnitude of a throttle valve opening of an internal combustion engine from its closed state to its open state can be a typical factor indicative of the state of operation of the internal combustion engine. Thus, with a conventional internal combustion engine using no EGR method, if a characteristic curve is plotted to show the relationship between the change in the state of the operation of the conventional engine and the amount of $NO_x$ emitted from said conventional engine, the curve will be the same as (I) in FIG. 3. However, if a similar characteristic curve is plotted to show a specific desired level capable of satisfying the recent legislative standards, the curve will be the same as (II) in FIG. 3. That is, if an internal combustion engine has a characteristic curve such as curve (II), the engine is acceptable not only from the point of view of the legislative standards but also from the point of view of ensuring appropriate engine performance. Therefore, when the EGR method is employed by an internal combustion engine to reduce the amount of $NO_x$ exhausted, said method must be carried out in such a manner that the characteristic curve of the internal combustion engine substantially corresponds to, or is close to curve (II) of FIG. 3. When this requirement is taken into consideration, the amount of the re-circulating exhaust gas from an exhaust system of the engine must be carefully regulated, so that the ratio of the amount of the total inactive gas (the residual gas within the engine plus the re-circulating exhaust gas from the engine exhaust system) to the amount of intake air introduced into the engine exhibits a characteristic curve such as the one shown by the broken line curve (IV) in FIG. 4A or 4B. That is, curve (IV) in FIGS. 4A and 4B show the desired characteristic relationship between the above-mentioned ratio and the state of operation of an internal combustion engine. It will be understood from the description below that the employment of the EGR system according to the present invention can readily and completely satisfy the above-mentioned requirement.

Figure 1:
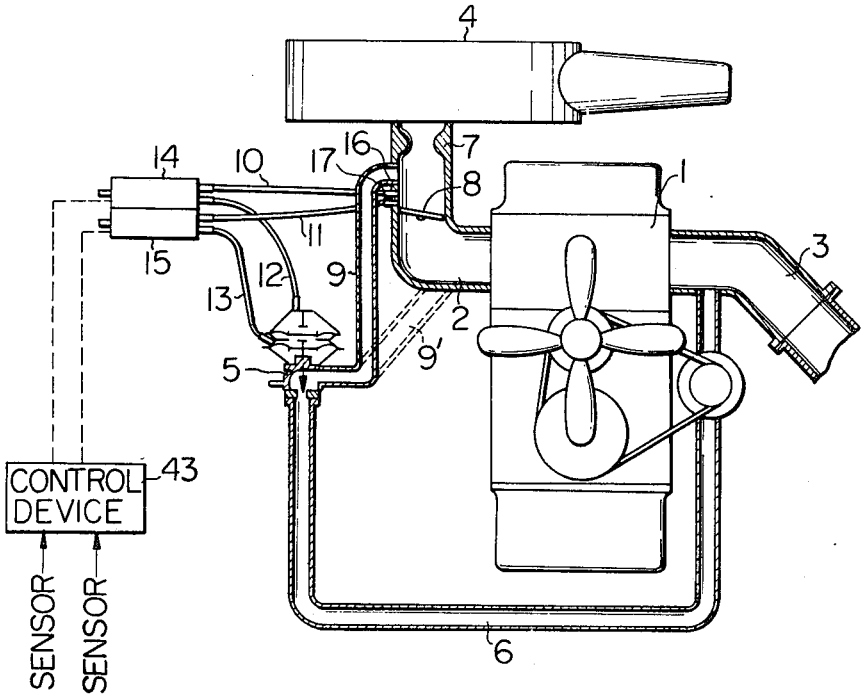
FIG. 1 is a schematic view showing the arrangement of an internal combustion engine provided with an EGR system according to the present invention.

Referring now to FIG. 1 which is a schematic view of the arrangement of an internal combustion engine provided with an EGR system according to the present invention, a body 1 of an internal combustion engine is provided with an intake duct 2 and an exhaust duct 3 connected thereto, respectively. Said intake duct 2 communicates with an air cleaner 4 through which the atmosphere flows into said intake duct 2. An EGR pipeline 6 extends to a flow-control valve 5 from a portion of the exhaust duct 3, so that a part of the exhaust gas from engine 1 flows into flow-control valve 5 via EGR pipeline 6. The exhaust gas flowing into said valve 5 is re-introduced into a predetermined portion of the intake system via a second EGR pipeline 9 or 9'. In the intake duct 2, a venturi 7 of a carburetor air horn is provided beneath the air cleaner 4. A throttle valve 8 of the carburetor is also provided in the portion downward from the venturi 7 so as to be rotatable about a pivot from its closed position to its fully opened position. It should be noted that in FIG. 1, the second EGR pipeline 9 is provided to carry out the re-introduction of the exhaust gas into a portion of the air horn above the throttle valve 8, while the second EGR pipeline 9' represented by broken lines is intended to show a case wherein a part of the exhaust gas re-circulated from the engine 1 is re-introduced into a portion of the intake duct 2 below the throttle valve 8. In FIG. 1, reference characters 10 and 11 designate vacuum pipelines through which the vacuum in the carburetor air horn is introduced into electro-magnetic valves 14 and 15 via vacuum ports 16 and 17 formed, respectively, in the wall of the carburetor. It should be understood that in the arrangement of FIG. 1, the vacuum port 17 is located immediately above the throttle valve 8 which is completely closed, while the other vacuum port 16 is located just above said vacuum port 17. That is to say, the location of the vacuum port 17 is selected so that when the throttle valve 8 is rotated by a predetermined small angle from the completely closed position until an edge of said throttle valve 8 moves past the vacuum port 17, said vacuum port 17 communicates with the intake duct 2 via the throttle valve 8. When the throttle valve 8 is further rotated from the pre-determined small angle position so that its edge moves past the vacuum port 16, said port 16 is placed in communication with the intake duct 2. Since the two vacuum ports 17 and 16 sequentially communicate with the intake duct 2, the vacuum pressure prevailing within said intake duct 2 is first introduced into the vacuum port 17 and then into the vacuum port 16. Instead of forming two vacuum ports 17 and 16 in the wall of the air horn, various types of valves such as a butterfly valve, may be used as long as two such valves are opened in sequence in response to a change in the opening position of the throttle valve 8 and as long as the vacuum pressure within the intake duct 2 is sequentially introduced into the opened two valves.

The above-mentioned electro-magnetic valves 14 and 15 both operate as selector valves. Therefore, when both valves 14 and 15 are opened for instance, the vacuum pressures of the vacuum ports 16 and 17 are introduced through the vacuum pipelines 10, 11, the opened electromagnetic valves 14, 15 and pressure pipelines 12, 13 into two pressure-control chambers of the flow-control valve 5 which will be described later, respectively. However, when valves 14 and 15 are closed, communication between pipelines 10 and 12 and between pipelines 11 and 13 is interrupted respectively, although the pressure pipelines 12, 13 are respectively, connected to the atmosphere, via the closed electro-magnetic valves 14 and 15.

Figure 2:
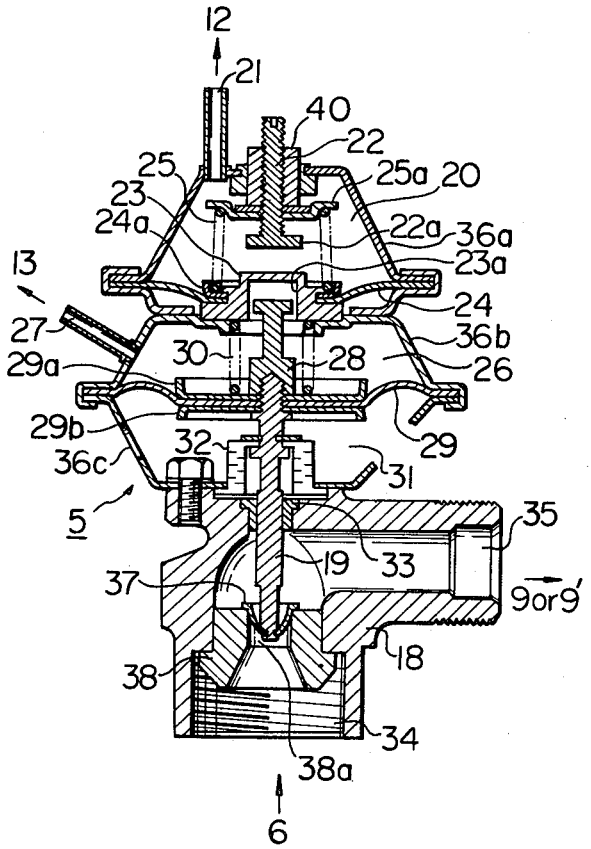
FIG. 2 is an enlarged cross-sectional view showing a flow-control valve employed in the EGR system of FIG. 1.

Referring now to FIG. 2 which shows the construction of the above-mentioned flow-control valve 5 in detail, a valve casing 18 is provided with an inlet port 34 connectable to the EGR pipeline 6 and with an outlet port 35 connectable to the second EGR pipeline 9 or 9'. An orifice element 38 having an orifice **38*a* is fixedly mounted between said inlet and outlet ports 34 and 35. A valve 37 connected to a valve stem 19 is placed on the orifice 38*a*. The valve stem 19 extends upwardly through a bearing 33 fitted in the valve casing 18, into an atmospheric pressure chamber 31, and is then connected to a stop member 28 which is provided in a first pressure-control chamber 26. The connection of the valve stem 19 to the stop member 28 is effected by an appropriate connecting means, such as a screw-coupling. The above-mentioned atmospheric pressure chamber 31 is defined in a lower housing 36*c* and communicates with the atmosphere through an aperture formed in said lower housing 36*c*. Onto the bottom of the atmospheric pressure chamber 31, a heat insulatable sealing 32 is fixed so as to prevent the leakage of the re-circulating exhaust gas from the interior of the valve casing 18 into the atmosphere through the bearing bore of the valve casing 18 in which the bearing 33 is fitted. The atmospheric pressure chamber 31 and the above-mentioned pressure control chamber 26 are separated from each other by a diaphragm 29 arranged therebetween in an airtight manner, and said first pressure control chamber 26 is defined by the diaphragm 29 and a middle housing 36***b*. Said diaphragm 29 is fixed to the valve stem 19 by means of upper and lower support plates 29*a* and 29*b*. Therefore, the vertical movement of the diaphragm 29 causes the integral movement of the valve stem 19 and the stop member 28 in the vertical direction. As a result, it will be understood that the opening and closing movement of the valve 37 is controlled by the diaphragm 29. A spring 30 is disposed in the first pressure control chamber 26 so that the lowermost end of the spring 30 lies on the above-mentioned upper support plate 29*a*. The uppermost end of the spring 30 is engaged with a lower surface of a movable holding plate 23 for holding a diaphragm 24 (which will be described later) of a second pressure-control chamber 20 facing the diaphragm 29. Thus, the spring 30 is free to stretch and contract within the first pressure-control chamber 26. The middle housing 36*b* is provided with a pressure intake pipe 27 attached thereto, which pipe 27 is connectable to the above-mentioned pressure pipeline 13. Thus, either the vacuum pressure from the vacuum port 17 via the pipeline 11 and the opened electro-magnetic valve 15 or the atmospheric pressure from the atmosphere via the closed electro-magnetic valve 15 is introduced into the first pressure-control chamber 26 by means of the pipeline 13. The second pressure-control chamber 20 defined by the diaphram 24 and an upper housing 36*a* is located above the first pressure-control chamber 20. The diaphragm 24 together with a seat plate 24*a* for a spring 25 are held by the above-mentioned movable holding plate 23, and provide an airtight partition between the first and second pressure-control chambers 26 and 20. As is clearly shown in FIG. 2, the movable holding plate 23 is formed with a recessed portion 23*a* at the central portion of the lower side thereof. Said recessed portion 23*a* receives the head portion of stop member 28 disposed in the first pressure-control chamber 26. It should be noted that the bottom surface of the recessed portion 23*a* against which the head portion of stop member 28 is urged when said stop member 28 is upwardly moved by the diaphragm 29, is normally spaced apart from the top surface of the head portion of said stop member 28. The distance between the bottom surface of the recessed portion 23*a* and the top surface of the head portion of the stop member 28 has a pre-designed value selected by adjusting the depth of the recessed portion 23*a*, for example. The previously-mentioned seat plate 24*a* and an upper stationary seat plate 25*a* hold the spring 25 therebetween. Thus, said spring 25 always applies a downward spring force to the diaphragm 24 via the seat plate 24*a*. A stop member 22 is disposed in the second pressure-control chamber 20 and has a stop head 22*a* projecting thereinto. The stop member 22 is threadably engaged with a nut 40 fixed to the topmost end of the upper housing 36*a*. Therefore, the amount of projection of the stop head 22*a* can be adjusted by screwing the stop member 22. The second pressure-control chamber 20 is provided with a pressure intake pipe 21 which is connectable to the pressure pipeline 12 of FIG. 1. Thus, when connected, the vacuum pressure of the vacuum port 16 can be brought into the second pressure-control chamber 20 while the pipelines 10 and 12 intercommunicate with each other via the electro-magnetic valve 14. Further, when the electromagnetic valve 14 is shifted so as to connect pipeline 12 to the atmosphere, atmospheric pressure is introduced into the second pressure-control chamber 20 through the pressure inlet pipe 21.

Reverting now to FIG. 1, various factors related to the operating conditions of an internal combustion engine and a vehicle, such as the temperature of the engine coolant, the vehicle speed, the vehicle acceleration, the shifting position of the transmission gears and the like are detected by the corresponding suitable sensors. The detected signals are then transmitted to an appropriate control device 43. Therefore, the control device 43 generates excitation signals by which the excitation windings (not shown) of the electro-magnetic valves 14 and 15 are energized so as to cause the valves 14 and 15 to shift when said valves 14 and 15 should be switched from the closed positions to the opened positions and vice versa, respectively. That is to say, the control device 43 controls the shifting timing of each electro-magnetic valve 14 or 15. Alternately, appropriate switching elements may be adopted to switch the pressure conditions of the first and second pressure-control chambers 26 and 20 of the flow-control valve 5, in replacement of the above-mentioned sensors, the control device 43 and the two electro-magnetic valves 14 and 15. If such switching elements are employed for detecting the temperature of the engine coolant, the vehicle speed or any of the other factors, said elements should be physically interposed between the pipelines 10, 11 and 12, 13.

The operation of the exhaust gas re-circulation system according to the embodiment shown in FIGS. 1 and 2 will be hereinafter described in connection with several specific operating modes of a vehicle.

1. When a vehicle is operated in a starting mode an idling mode, a decelerating mode or a high load mode.

When a vehicle is operated in one of the above operating modes, the throttle valve 8 of the carburetor is returned to its completely closed position. Therefore, neither of the vacuum ports 16 or 17 is influenced by the vacuum pressure prevailing within the intake duct 2. As a result, the vacuum of both ports 16 and 17 drops to a level close to the atmospheric pressure level. During said operating modes, the electro-magnetic valves 14 and 15 are shifted so that communication between the pipelines 10 and 12, and also communication between the pipelines 11 and 13 are effected, respectively. However, since only a low level vacuum pressure is introduced into the second pressure-control chamber 20 of the flow-control valve 5, the movable holding plate 23 is pressed by the downward force of the spring 25 against the uppermost surface of the middle housing 36*b*. The first pressure-control chamber 26 is also kept at a very low level of vacuum pressure. Thus, the spring 30 exerts its downward force onto the upper support plate 29*a* thereby causing the displacement of the valve stem 19 together with the diaphragm 29 and the stop member 28 to the lowermost position of said valve stem 19. As a result, the valve 37 attached to the lowermost end of the valve stem 19 covers the orifice 38*a*. Therefore, the re-circulation flow of the exhaust gas from the exhaust system into the intake system of an internal combustion engine is interrupted by the valve 37 of the flow-control valve 5. In fact, it should be understood that in these operating modes of a vehicle, the amount of $NO_x$ exhausted from the engine is maintained at a low level as is obvious from the characteristic curve (I) of FIG. 3. Thus, exhaust gas re-circulation is not necessary for these operating modes.

2. When a vehicle is operated at a medium acceleration and ordinary speed mode.

When a vehicle is in this operating mode, the throttle valve 8 of the carburetor is rotated from its completely closed position to a position whereat only the vacuum port 17 located below the port 16 is under the influence of the vacuum pressure prevailing within the intake duct 2. That is to say, the throttle valve 8 is positioned above the vacuum port 17, but below the vacuum port 16. In this operating mode, the electro-magnetic valves 14 and 15 are both shifted so that communication between the pipelines 10 and 12, and also communication between the pipelines 11 and 13 are effected via said valves 14 and 15. As a result, the vacuum pressure from the intake duct 2 is introduced into only the first pressure-control chamber 26 of the flow-control valve 5 via the vacuum port 17, the pipeline 11, the electro-magnetic valve 15, and the pressure pipeline 13. The number of revolutions of the internal combustion engine is increased during this mode so as to maintain an ordinary vehicle speed. Therefore, the level of the vacuum pressure within the intake duct 2 is also increased so that when said vacuum pressure is introduced into the first pressure-control chamber 26, the pressure difference between said vacuum pressure within said chamber 26 and the atmospheric pressure within the atmospheric pressure chamber 31 causes the upward displacement of the diaphragm 29 against the downward force of the spring 30. As a result, the valve stem 19 together with the stop member 28 are lifted by the diaphragm 29 until the head of said stop member 28 impinges upon and is stopped by the bottom of the recessed portion 23*a* of the movable holding plate 23. Consequently, the valve 37 attached to the valve stem 19 is moved apart from the orifice 38*a* thereby uncovering said orifice 38*a.* The uncovered orifice 38*a* permits the re-circulating exhaust gas to flow from the inlet port 34 toward the outlet port 35 of the flow-control valve 5. The amount of re-circulating gas permitted to flow through an opening provided between the valve 37 and the orifice 38*a* is regulated by the amount of the upward movement of the valve stem 19. It should be noted that the amount of the upward movement of said valve stem 19 is restricted to the distance between the bottom of the recessed portion 23*a* of the movable holding plate 23 and the top surface of the stop member 28. Thus, in this operating mode, it should be understood that the amount of flow of the re-circulating exhaust gas is set at a very low level. The re-circulating exhaust gas passing through the outlet port 35 of the flow-control valve 5 is re-introduced into the engine 1. The ratio between the amount of the re-introduced inactive gas containing the re-circulated exhaust gas in this operating mode and the amount of flow of the fresh intake air introduced from the carburetor is shown by the first step portions of the characteristic curves (V) and (VI) of FIGS. 4A and 4B. It should be noted that the first step portion of the characteristic curve (V) of FIG. 4A shows a case where the EGR system according to the present invention employs the second EGR pipeline 9 of FIG. 1, so that the re-circulating exhaust gas is re-introduced into a portion of the carburetor air horn above the throttle valve 8. The first step portion of the characteristic curve (VI) of FIG. 4B shows a case where the EGR system according to the present invention employs the second EGR pipeline 9' of FIG. 1 so that the re-circulating exhaust gas is reintroduced into a portion of the intake duct 2 below the throttle valve 8.

3. When a vehicle is at high acceleration or high speed operating modes.

In this type of operating mode, the throttle valve 8 of the carburetor is widely opened until both vacuum ports 16 and 17 are under the influence of the intake duct vacuum. The electro-magnetic valves 14 and 15 are naturally shifted so that communication between the pipelines 10 and 12 and communication between the pipelines 11 and 13 are effected by said valves 14 and 15, respectively. It will be understood that during these operating modes, the internal combustion engine rotates at a very high speed and thus, the intake duct vacuum reaches a very high level. Therefore, the vacuum pressure prevailing in the first and second pressure-control chambers 26 and 20 of the flow-control valve 5 is also raised to a very high level. As a result, the difference between the atmospheric pressure prevailing in the atmospheric pressure chamber 31 and the above-mentioned high level vacuum pressure, is increased. Consequently, in comparison with the above case (2), not only the diaphragm 29 of the first pressure-control chamber 26 but also the diaphragm 24 of the second pressure-control chamber 20 are upwardly displaced due to the increased pressure difference against the downward forces exerted by the springs 30 and 25. It should be appreciated that the forces of said springs 25 and 30 are appropriately pre-selected so as to ensure that the above-mentioned upward displacements of both diaphragms 24 and 29 occur. The upward displacement of the diaphragm 24 is permitted until the top surface of the holding plate 23 abuts against the stop head 22*a* of the stop member 22. The upward displacements of both diaphragms 24 and 29 cause an increase in the amount of upward movement of both the valve stem 19 and the valve 37 attached thereto, in comparison with case (2). That is to say, the valve 37 moves far away from the orifice 38*a* so that the opening through which the re-circulating exhaust gas flows from the inlet port 34 to the outlet port 35 of the valve casing 18, is widened. This causes an increase in the amount of the flow of the re-circulating exhaust gas. It will now be readily understood that when a vehicle is operated at the operating modes of case (3), the ratio of the re-introduced inactive gas to the intake air can be increased due to an increase in the amount of the flow of the re-circulating exhaust gas. It should be noted that the second step portions of the characteristic curves (V) and (VI) of FIGS. 4A and 4B represent how said ratio of the re-introduced inactive gas is increased under the control of the EGR system according to the present invention.

4. When an internal combustion engine mounted on a vehicle is at its full load operation.

When the full load operation of the internal combustion engine is reached, the electro-magnetic valves 14 and 15 are still being shifted so that the first and second pressure-control chambers 26 and 20 are both intercommunicated with the vacuum ports 17 and 16, respectively, via said electro-magnetic valves 15 and 14. The throttle valve 8 of the carburetor is completely opened causing the vacuum produced in the intake duct 2 to drop to a low level. Thus, the vacuum pressure prevailing in the regions of the vacuum ports 16 and 17 drops to a very low level. As a result, the vacuum pressure produced in the first pressure-control chamber 26 and in the second pressure-control chamber 20 is naturally small. Thus, the spring 25 urges the downward displacement of the diaphragm 24 and the downward movement of the holding plate 23 until said holding plate 23 is stopped by the uppermost surface of the middle housing 36*b*. Similarly, under the influence of the spring 30, the diaphragm 29 is downwardly displaced until the valve 37 connected to the valve stem 19 is engaged with the orifice element 38 so as to cover the orifice 38*a*. Consequently, the opening through which the re-circulating exhaust gas flows from the inlet port 34 to the outlet port 35 of the valve casing 18 is interrupted by the valve 37, so that the re-introduction of the re-circulating exhaust gas into the intake system is stopped. Therefore, the ratio of the amount of the re-introduced inactive gas to the amount of the intake air is suddenly reduced when the internal combustion engine provided with the EGR system according to the present invention approaches its full load operation. This is shown by the steeply sloping down portions of characteristic curves (V) and (VI) of FIGS. 4A and 4B. It will be understood that the above-mentioned sloping down portions correspond to desired characteristic curve (IV) shown by a broken line in FIGS. 4A and 4B.

5. When the electro-magnetic valves 14 and 15 are shifted so that the first and second pressure-control chambers 26 and 20 of the flow-control valve 5 communicate with the atmosphere.

This case is somewhat different from the above cases (1) through (4). In this case the timing of effecting the EGR operation is controlled depending upon the operating conditions of the engine and the vehicle in which the engine is mounted. Changes in the operating conditions of the engine and vehicle are picked up by the sensors for detecting such factors as an engine coolant temperature, ambient temperature, vehicle speed, and gearshift position. The detected signals of the sensors are transmitted to the control device 43 of FIG. 1, which then transmits an excitation signal to the excitation coils of the electro-magnetic valves 14 and 15, so that said valves 14 and 15 are shifted so as to interrupt communication between pipelines 10 and 12, and communication between pipelines 11 and 13, respectively. Thus, the pressure pipelines 12 and 13 both communicate with the atmosphere via said shifted valves 14 and 15. Accordingly, the first and second pressure-control chambers 26 and 20 also communicate with the atmosphere. As a result, the pressure difference between the atmospheric pressure chamber 31 and the first and second pressure-control chambers 26 and 20 is obviated. Therefore, the valve stem 19 and the valve 37 are downwardly moved until said valve 37 covers the orifice 38*a*. Consequently, the re-circulating exhaust gas is not re-introduced into the intake system of the engine. From the foregoing, it will be understood that in the EGR system of the present invention, when exhaust gas re-circulation is not necessary from the point of view of the operating conditions of an engine and a vehicle, it is possible to interrupt the EGR pipeline. It should be understood that the operating conditions during which the re-circulation of the exhaust gas is not necessary should be appropriately selected so as to satisfy the legal requirements for reducing $NO_x$.

As will be understood from the foregoing description of cases (1) through (5), the provision of the EGR system of the present invention for an internal combustion engine ensures that the characteristic curves (V) and (VI) which indicate the EGR ratio to the amount of intake air, approaches the pre-desired characteristic curve (IV). As a result, the characteristic curve (III) of FIG. 3 indicating the amount of $NO_x$ exhausted from an engine having the EGR system of the present invention can be brought very close to the desired curve (II) to satisfy the legal requirements for reducing the amount of $NO_x$ contained in exhaust gas from vehicle engines.

From the entire foregoing description, it will further be understood that the EGR system according to the present invention guarantees that the EGR method can be used effectively in any of the positions of a throttle valve of a carburetor by employing a single flow-control valve. In addition, the employment of a single flow-control valve enables the achievement of the reduction of the manufacturing and assembling costs of an EGR system, since the pipeline arrangement and the mounting of a single flow-control valve are very simple in comparison with those of the conventional EGR system.

What is claimed is:

1. An exhaust gas re-circulation system for an internal combustion engine, comprising an exhaust gas re-circulation pipeline extending between intake and exhaust systems of the internal combustion engine for re-introducing a part of the exhaust gas from the exhaust system into the intake system, a single flow-control valve for regulating the flow of the re-introduced exhaust gas, which valve comprises: an orifice element arranged in a portion of the exhaust gas re-circulation pipeline to provide said portion with an orifice through which the exhaust gas flows from said exhaust system toward said intake system; a valve element movably placed over the orifice and having an axially extended valve stem; a first displaceable diaphragm member connected to the valve stem for actuating movement of the valve element away from said orifice; a second displaceable diaphragm member axially spaced apart from the first diaphragm member and having means for limiting the movement of said valve element; a first closed pressure-control chamber defined between the first and second diaphragm members; a second closed pressure-control chamber arranged adjacent to, but separated from said first closed pressure-control chamber by said second diaphragm member, and; an atmospheric pressure chamber arranged adjacent to, but separated from said first closed pressure-control chamber by said first diaphragm member, and means for generating in first said first and then in said second pressure-control chambers, individual vacuum pressures changing in response to change in the opening position of a throttle valve of the intake system from the closed position thereof, said vacuum pressure generating means comprising a first vacuum pressure line extending from said first pressure-control chamber of the flow-control valve to a first vacuum port provided in said intake system, and a second vacuum pressure line extending from said second-pressure control chamber of the flow-control valve to a second vacuum port provided in said intake system, said first and second vacuum ports being located such that when said throttle valve is opened gradually from the closed position thereof, an edge of said throttle valve moves past said first and second vacuum ports in sequence, said separate vacuum pressures of said first and second pressure-control chambers causing sequential displacements of said first and second diaphragm members thereby moving said valve element away from said orifice in a two step-like manner.

2. An exhaust gas re-circulation system according to claim 1, wherein said flow-control valve further comprises means for assisting said valve element to return toward the orifice when said vacuum pressures of said first and second pressure-control chambers are removed.

3. An exhaust gas re-circulation system according to claim 2, wherein said assisting means comprise first and second spring elements disposed in said first and second pressure-control chambers, respectively, said first and second spring elements always exerting forces to eliminate displacements of said first and second diaphragm members.

4. An exhaust gas re-circulation system according to claim 1, wherein said limiting means of said second diaphragm member of said flow-control valve is a plate member having a recessed portion with a bottom against which said valve stem abuts when the movement of said valve element is actuated by said first diaphragm member.

5. An exhaust gas re-circulation system according to claim 1, wherein said flow-control valve further comprises an adjustable stop means for adjustably limiting the maximum movement of said valve element away from said orifice.

6. An exhaust gas re-circulation system according to claim 5, wherein said adjstable stop means comprise a nut provided at one end of said second pressure-control chamber spaced apart from said second diaphragm member, said nut having a threaded bore therein, and a threaded stop member engaged with said nut and projecting into said second pressure-control chamber.

7. An exhaust gas re-circulation system according to claim 1, wherein said system further comprises a selector valve means provided in said first and second vacuum pressure lines between said first and second pressure-control chambers and said first and second vacuum ports, said selector valve being able to be shifted so that communication between said first and second pressure-control chambers and said first and second vacuum ports is interrupted, and at the same time, communication between said first and second pressure-control chambers and the atmosphere is immediately effected.

8. An exhaust gas re-circulation system according to claim 7, wherein said system further comprises means for causing shifting of said selector valve means when the internal combustion engine is operated under pre-determined operating conditions.

9. An exhaust gas re-circulation system according to claim 8, wherein said selector valve means comprise first and second electro-magnetically operated selector valves arranged in said first and second vacuum pressure lines, respectively, said first and second selector valves being shifted upon being electrically excited, and wherein said shift-causing means comprise a control device for issuing electrical excitation signals transmitted to said selector valves when it is sensed that the internal combustion engine is being operated under one of said pre-determined operating conditions.

* * * * *